US005459442A

United States Patent [19]

James

[11] Patent Number: 5,459,442

[45] Date of Patent: Oct. 17, 1995

[54] HIGH POWER RF PHASE SHIFTER

[75] Inventor: Jesse C. James, Huntsville, Ala.

[73] Assignee: McDonnell Douglas Corporation, St. Louis, Mo.

[21] Appl. No.: 377,772

[22] Filed: Jan. 23, 1995

[51] Int. Cl.[6] ..... H01P 1/18

[52] U.S. Cl. ..... 333/156; 333/160

[58] Field of Search ..... 333/22 F, 81 B, 333/99 R, 156, 157, 160, 245, 248

[56] References Cited

U.S. PATENT DOCUMENTS

| | | | |
|---|---|---|---|
| 3,432,777 | 3/1969 | Taylor et al. | 333/159 |
| 3,631,501 | 12/1971 | Buscher | 343/754 |
| 3,701,058 | 10/1972 | Smith | 333/159 |
| 3,805,197 | 4/1974 | Buscher | 333/157 |
| 4,788,515 | 2/1988 | Wong et al. | 333/160 |
| 4,800,350 | 1/1989 | Bridges et al. | 333/239 |
| 4,982,171 | 1/1991 | Figlia et al. | 333/157 |

FOREIGN PATENT DOCUMENTS

| | | | |
|---|---|---|---|
| 30801 | 2/1986 | Japan | 333/157 |

*Primary Examiner*—Paul Gensler

*Attorney, Agent, or Firm*—Ronald M. Goldman; John P. Scholl

[57] ABSTRACT

An adjustable phase shifter is formed of an RF transmission line having an internal cavity, in which the phase shift produced is determined in part by a mound of flowable dielectric material in the internal cavity. An inlet tube defines a chute for dispensing the dielectric material into the internal cavity and a capped outlet tube connected to a bottom end of the internal cavity defines another gravity chute through which the dielectric material is removed to lower the height of the mound, when the cap is removed from the tube. The electrical length of the phase shifter is increased with addition of dielectric material and decreased with removal thereby varying the effective length of the RF transmission line and the phase shift produced on the RF that propagates therethrough.

15 Claims, 1 Drawing Sheet

HIGH POWER RF PHASE SHIFTER

FIELD OF THE INVENTION

This invention relates to electrical phase shifters and, more particularly, to a novel phase shifter structure that allows easy phase shift adjustment of high power RF in antenna phasing systems, even while the antennas are active.

BACKGROUND

An AC signal, one whose amplitude cyclically varies with time, requires a finite time to propagate through various transmission media, such as a capacitance, an inductance or an RF transmission line. After propagating through such media, the phase of the AC signal that exits differs from the phase of the same signal as applied to such media, unless the length of the propagation path through the media is exactly one wavelength in length or an exact multiple thereof. When the length is an exact multiple of the wavelength, the signal's phase undergoes a shift of exactly three hundred and sixty degrees or one cycle. The effect is inherent. In circuit applications in which the phase of one ac signal is critical relative to another ac signal, it often becomes necessary to adjust the amount of phase shift that occurs. That is accomplished by placing an inductor and/or capacitance, referred to as phase shifters, in the signal path of one of the ac signals to account for the greater travel time in one portion of the circuit so that the desired phase relationship between the two differently routed signals is restored. Such phase shifters and their function are well understood.

One common phase shifter application is in phasing of transmitting antennas. In a commercial broadcasting system an RF transmitter delivers RF, modulated with voice, data and/or video information, to an antenna. The antenna radiates that RF into the atmosphere and space, through which the RF propagates over great distances to various receiving stations, such as one's home radio and/or television receiver. There the RF is demodulated and the intelligible information is audibly and/or visibly displayed.

Often the intended receiving stations are not symmetrically displaced from the transmitting antenna. That is particularly true for commercial broadcasting systems, where the broadcast licenses granted by the government, divide geographic regions into separate receiving territories serviced by different broadcast stations. It is therefore desired to broadcast the RF only in a particular direction and over a particular territory so as to avoid interference with another broadcast station operating at or near the same broadcast frequency covering an adjacent territory, ensuring that one station's broadcast does not spill over into the territory of the other. To avoid spillover in those situations and for other reasons, the broadcast stations antennas are designed to be directional.

To achieve directionality, an array of antennas is often used, consisting typically of two or four spaced antennas, that are fed by a single transmitter. The broadcast transmitter's output is coupled to each antenna in the array by a transmission line, suitably a co-axial transmission line, and the antennas are thereby separately fed with RF from the broadcast transmitter. The phase of the RF at each antenna is adjusted in accordance with known phasing principles to differ in such a way as allows the antenna array to produce a well defined directional characteristic or territorial "footprint".

Phase shifters for that application must be capable of handling high power levels of RF. They also must permit some adjustment, since the antenna array when first installed will rarely require the exact amount of phase shift that an "off the shelf" phase shifter provides. Further, the phase shifter should be capable of adjustment, even while under RF load, during the course of broadcasting, so as not to disrupt programming as well as to permit more accurate field monitoring and measurement of radiation levels received at various distances from the transmitting antennas.

At present high power phase shifters that accomplish that function incorporate capacitors and variable inductors. The phase is adjusted by moving the tap on a large inductor, and this is normally done with the transmitter off. Until the present the use of a variable length transmission line to change the phase is not known.

An object of the present invention is to provide a high power adjustable phase shifter in which the propagation time through the phase shifter is adjusted while power is flowing through the line.

A further object of the present invention is to provide a new and easily manufactured high power RF phase shifter that permits easy adjustment of the phase shift characteristic, without the necessity of employing adjustable inductors.

And an ancillary object of the invention is to provide new compositions of dielectric material particularly useful in achieving requisite phase velocity levels in high power RF phase shifters.

SUMMARY OF THE INVENTION

An electrical phase shifter, according to the invention, includes an RF transmission line, suitably a coaxial line in which a conductive cylinder and a cylindrical conductor are oriented in coaxial relationship, defining an annular internal cavity of a certain diameter and providing an RF transmission path that extends the height of the cylinder. A small diameter inlet tube, connected to an upper end of said internal cavity, defines a gravity chute for dispensing flowable dielectric material, preferably granular in form, into the internal cavity under the influence of gravity. The granulated dielectric material forms a mound that at least partially fills the height of the internal cavity. And a capped outlet tube, connected to a bottom end of the internal cavity, defines another gravity chute for the granular dielectric material through which granular dielectric material is removed from the internal cavity, under the influence of gravity, thereby lowering the height of the capacitive mound. When the cap is removed from the outlet tube, the grains of dielectric material are dispensed from the underside of the mound to exit the phase shifter. In alternate embodiments a liquid dielectric may be employed instead of the dielectric grains.

The electrical length of the phase shifter is increased with addition of dielectric material and is decreased with removal thereby varying the effective length of the RF transmission line and the phase shift produced on the RF that propagates therethrough. By uncapping the outlet tube and removing some dielectric material through the outlet port the phase shift is reduced; by pouring additional dielectric material into the inlet port, the phase shift is increased. In as much as the inlet and outlet tubes are of small diameter or contain a mesh with small sized openings, RF propagating through the cylinder cannot escape through those openings. Consequently, the phase shift adjustment is easily performed even while the phase shifter remains under RF load.

The dielectric material, preferably, is of a dielectric constant $\epsilon$ and a magnetic permeability characteristic $\mu$ in which the ratio of $\mu$ to $\epsilon$ is approximately unity. That characteristic may be attained by a single material. It may also be achieved with a mixture of materials of different permeability and dielectric constant, one having a collective permeability and dielectric constant that bears a unity ratio.

The foregoing and additional objects and advantages of the invention together with the structure characteristic thereof, which was only briefly summarized in the foregoing passages, becomes more apparent to those skilled in the art upon reading the detailed description of a preferred embodiment, which follows in this specification, taken together with the illustration thereof presented in the accompanying drawings.

DESCRIPTION OF THE PREFERRED EMBODIMENTS

Figure 1:
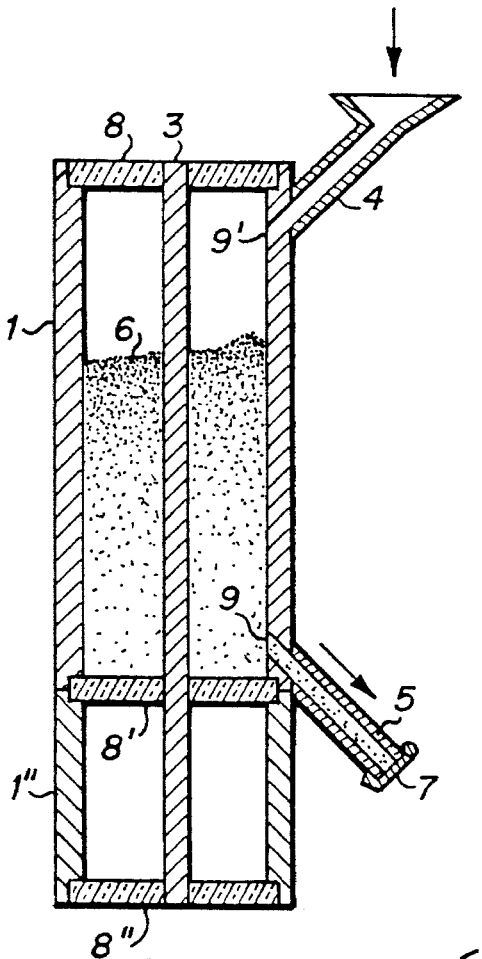
FIG. 1 is a section view of an embodiment of the novel phase shifter.

Reference is made to FIG. 1, illustrating a preferred embodiment of the phase shifter in section view. The phase shifter is intended to be coupled in series in a coaxial transmission line and, hence, contains a center conductor 3 and a coaxially arranged cylindrical conductive wall 1, which surrounds and is spaced from conductor 3 and defines a coaxial type transmission line that extends the length or height, as variously termed, of cylinder 1. Disk shaped dielectric spacers 8 and 8', each containing a central opening in which to allow the center conductor to pass through, are located at each end of the cylinder to support center conductor 3 in the coaxial arrangement. The spacers maintain the separate conductors insulated from direct electrical contact with one another.

The space or chamber between the conductors is in part air, which is an insulator of known dielectric characteristic, and is partially filled with a granulated dielectric material 6, which is discussed in greater detail hereafter. The dielectric material is formed of individual grains that are piled high into a mound.

A small diameter hollow tube 4 extends in an almost vertical position downward to the top of cylindrical wall 1 and opens into the annular chamber. The tube serves as an inlet for admitting the granulated dielectric material into the chamber. Typically the size of the opening in tube 4 is ⅛th inch (⅓ cm.). The size can be much larger, however, when a wire mesh 9 is used to cover the opening. The size of the openings in the mesh or tube is always much less than the operating wavelength so that a negligible amount of radio energy escapes through the tube.

Another small hollow tube 5 is connected at the lower end of cylinder 1 and slopes downward. The tube contains an entry passage that opens into the annular chamber on the underside of the mound of grains. Tube 5, the outlet, provides a passage for removing dielectric from the chamber. A closure 7, specifically a hinged baffle of known construction, closes the end of the tube, normally, so as to prevent escape of the dielectric grains. When it is desired to remove some or all of the dielectric filling, the closure is opened and the grains are dispensed under their own weight. The closure member may be a screw on cap, a snap on cap, and/or a hinged member or cover.

Figure 2:
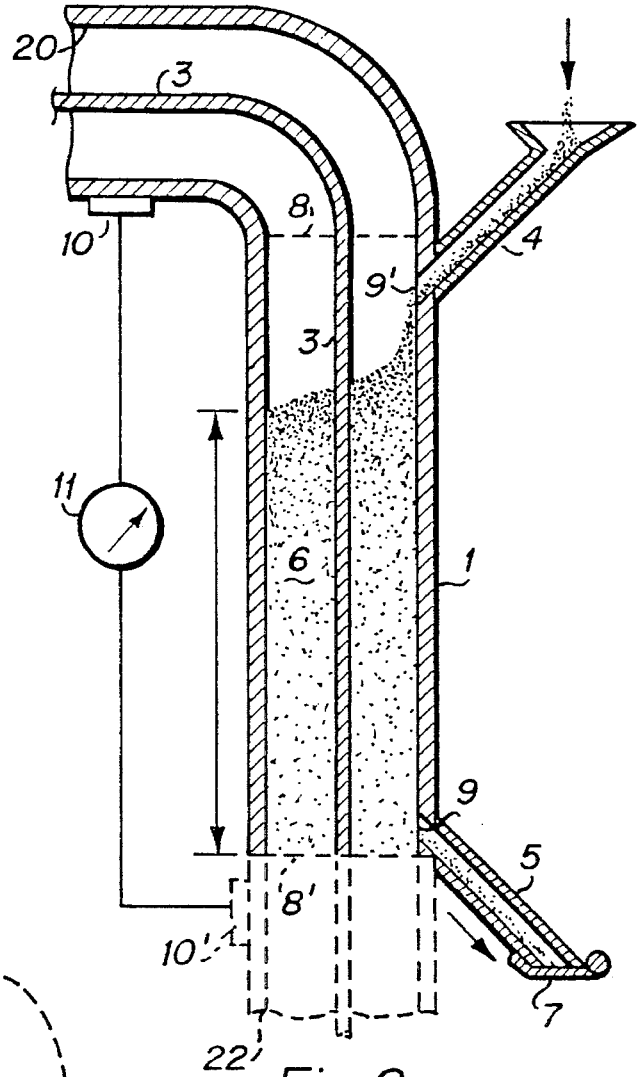
FIG. 2 symbolically illustrates the embodiment of FIG. 1 within a coaxial transmission line.

The top and bottom ends of the phase shifter are connected to respective coaxial transmission lines as symbolically illustrated in FIG. 2. To mechanically accommodate a connection between the transmission line and the bottom end of the phase shifter of FIG. 1, a coaxial cup shaped adapter, 1", is attached to the described structure. The adapter includes an annular dielectric disk 8" to space and support the center conductor from the annular tubular walls. The adapter is in all respects an extension of the transmission line. The adapter spaces the location at which the transmission line connection is to be made from outlet 5, avoiding any mechanical interference between the transmission line connector and the outlet tube.

Dielectric material 6 is a mixture of finely ground ceramic titanate powder to supply a large dielectric constant and a sintered powder mixture of manganese ferric oxide and zinc ferric oxide to supply a large magnetic permeability. These powders, like sand, is flowable in the sense that the grains may be poured. However, many other powders, in particular spherules of a selected magnetic ferrite, and even liquid slushes may be substituted as discussed hereafter in greater detail. The powder should be non-caking and non-settling even under conditions of high humidity.

As thus used in reference to the dielectric, the term flowable appears to be a suitable generic term, for lack of a better one, that means that the material can flow under the influence of gravity, a characteristic used in the context of the invention. Such characteristic encompasses granular material, which like grains of sand, flows under the influence of gravity, when the gravitational force exceeds the force holding the grain in place. Such a characteristic also encompasses liquids, which as is known flows more easily under the influence of gravity than the granular material and slurries.

Cylinder 1 is oriented vertically so as to take full advantage of gravity in inserting grains or in removing them. The dielectric material is formed of individual grains that are piled into a mound. With outlet 5 closed, the dielectric is introduced into the cavity by pouring the grains from a separate reservoir or container into inlet 4, which serves as a chute. The dielectric grains slide down the inlet chute and into the cavity under the force of gravity to form an annular ring or mound within the annular cavity. The amount of dielectric powder needed in some circumstances can be pre-computed, but the preferred method requires a phase measuring instrument to be observed as the grains are poured in. This instrument is not shown, but is well known to those skilled in the art.

The technician pouring in or removing the grains may be in telephone contact with another technician at another location who is monitoring the effect of the added grains by phase measuring instruments or power density meters. These monitoring techniques are well known to those skilled in the art. A trial and error procedure may be used. In any case, the procedure continues until the correct degree of phase shift is achieved.

A phase measuring instrument may be used to measure the phase difference between a radio signal at two points in the line. This is illustrated in FIG. 2 to which reference is made. As shown, two couplers, 10 and 10', sample the signal before and after the phase shifter. These two points may alternatively be two antenna elements. In FIG. 2 the phase meter is shown as 11, and can be easily monitored as dielectric is added or removed.

When it is desired to reduce the amount of phase shift, outlet baffle 7 is opened and a measure of material is allowed to be released or dispensed via the outlet, which also acts as a chute. The grains are dispensed from the outlet under the force of gravity, that is, under their own weight, reducing the height of the mound of dielectric material in the cavity.

In operation the phase shifter is connected intermediate the transmitter and antenna to the RF coaxial cables that carries RF from the transmitter and the cable to the antenna, such as is illustrated symbolically in FIG. 2 to which reference is made. For convenience, the elements of the phase shifter shown in this figure that also appeared in FIG. 1 are given like numerical designations. As illustrated, a coaxial line 20, partially illustrated, supplies RF from the transmitter to the top end of the phase shifter. Another coaxial line 22 is connected to the bottom end of the phase shifter and couples the RF which propagates therethrough to the antenna, not illustrated. The coaxial cables are also air dielectric, but other cables with conventional filling of a solid dielectric material may be substituted.

The speed of radio energy propagation along the transmission line is equal to the velocity of light in a vacuum divided by the square root of the product $\mu\epsilon$, where $\mu$ is the relative magnetic permeability and $\epsilon$ is the relative dielectric constant of the propagating medium, in this structure the material 6, called the dielectric, which is physically located in the annular region between the center conductor 3 and the cylindrical outer conductor 1. For air the product $\mu\epsilon$ is equal to unity. For the solid granular material, $\mu\epsilon$ can be much larger, as much as ten thousand or more with presently available materials.

The electrical length of the transmission line for an RF signal of wavelength f is determined by the physical length and the product $\mu\epsilon$ of the dielectric. The electrical length determines the phase of the RF signal at the end of the transmission line, the location at which the signal is applied to the antenna. When the electrical length changes by f wavelengths, each wavelength representing 360 degrees, the phase, as expressed in degrees, changes by f multiplied by 360 degrees.

For example, given two coaxial transmission lines of identical physical length, each including an empty phase shifter, if a granular material with a large $\mu\epsilon$ is added to the first phase shifter so that the electrical length of the transmission line increases by 0.4 wavelengths, the phase increases by 144 degrees. Thus although the physical length of the two transmissions lines are the same, the second line is 144 degrees greater in electrical length. As additional example, with a 1.2 meter height of granular dielectric material that has a $\mu\epsilon$ of 10,000 added into the transmission line, particularly into the previously empty phase shifter, as in FIG. 2, the added material causes an additional phase change of 144 degrees to an RF signal of 1 MHz. Such a large increase in phase is not ordinarily needed in operation, because the transmission line length for a given antenna will be constructed with a phase error that is much less than 144 degrees and, usually, only a small phase adjustment is necessary. In practice, thus, the line length of the phase shifter, 1, need not be larger than one meter, even for the lowest commercial broadcast frequency, 550 KHz. For much higher RF frequencies, a $\mu\epsilon$ product for the dielectric of much less than 10,000 would ordinarily suffice.

As the RF propagates through the transmission line toward the antenna, the RF first encounters the dielectric material 6, which is a change in the dielectric medium from that preceding in the line, a discontinuity. As a consequence of that discontinuity, an unwanted reflection of a part of the RF occurs, unless the ratio of $\mu$ to $\epsilon$, $\mu/\epsilon$, is approximately unity. Consequently, to minimize unwanted reflections, a second desirable characteristic for the granular dielectric material is that the material should have a $\mu$ that is approximately equal in magnitude to its $\epsilon$. That equality is achieved by mixing appropriate volumes of different material having a high $\mu$ and a high $\epsilon$. These are well understood electronic characteristics in the radio transmission fields.

Numerous materials have a large magnetic permeability, $\mu$. Numerous materials have a high dielectric constant, $\epsilon$. It may be noted that dielectric constant and electric permittivity are used interchangeably in the literature. Many materials have both a large $\mu$ and a large $\epsilon$. In the latter class are magnetic ferrites of which garnets are a subclass. A magnetic ferrite is an insulator or dielectric having magnetic properties. Some housewives use chunks of ferrites as magnets to hold the grocery list to the refrigerator door. Other examples of magnetic materials are iron oxides; mixtures of many types of iron oxides; compounds of iron, manganese, zinc, aluminum, titanium, molybdnium, cobalt, nickel, boron, silicon, and oxygen; and powdered ferrites.

The manufacturing method of ferrites greatly affects the $\mu$ and the $\epsilon$. On the industrial market are high-$\mu$ materials with names such as Permalloy, Feroxcube, Alnico, Hyflux, and Supermalloy. Examples of high dielectric-constant materials are metallic titanates, titanium dioxide, some industrial ceramics and porcelains, and some liquids such as water, alcohols, and glycols. Magnetic slushes can be purchased on the industrial market, and are ideal for small $\mu$ and $\epsilon$. Magnetic slushes are not commercially available yet with $\mu$ larger than 2.5. However, magnetic slushes can be very useful when only small changes in phase are required, or for high frequencies.

An attempt should be made to mix the powders or slushes so that $\mu/\epsilon$ is unity within 5% at the operating temperature. This tolerance will hold mismatch losses to within about 2%; however, the mismatch losses can be eliminated by small adjustments in the transmitter-to-antenna matching devices, a procedure always followed by a skilled electronic technician.

Materials should preferably be mixed experimentally in a laboratory to arrive at powder 6 of FIGS. 1 and 2. Mixtures are approximately linear over small ranges, but $\mu$ changes more rapidly than $\epsilon$ as dilution of the magnetic grains occurs. A preferred procedure is to purchase ferrites having $\epsilon$ less than one half the magnitude of $\mu$, grind these ferrites into a small-grain powder or preferably into spherules, then test the mixture according to standard procedures known in the art using a transmission line. The $\mu$ will decrease to about half the value that the solid ferrite had, and the $\epsilon$ will decrease to about 90% of the solid ferrite value. The $\epsilon$ of the mixture can be increased by adding a small amount of a high-$\epsilon$ powder, such as barium titanate, ground finer than the ferrite.

A constant line impedance requires that the ratio, $\mu/\epsilon$, not change as dielectric material is added. The phase changes when the added dielectric material has the product, $\mu\epsilon$, greater than unity.

Figure 3:
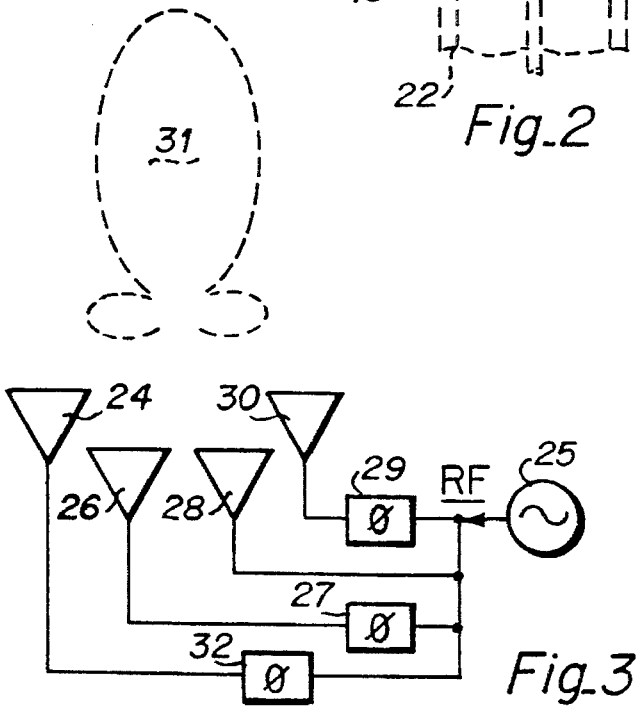
FIG. 3 is a schematic representation of a phased antenna array broadcast system which employs the novel phase shifter.

The adjustable phase shifter has particular utility for phasing antenna arrays while the antennas remain under load transmitting RF. That is particularly so for those antenna arrays used for commercial AM broadcasting in which, typically, two to four separate spaced vertical quarter wave antennas are used to define the broadcasters directional characteristic or "footprint". As is schematically illustrated in FIG. 3, an antenna phasing arrangement contains four antennas, 24, 26, 28 and 30, which are supplied with RF from transmitter 25. Phase shifters 27, 29 and 32, identical in structure to the embodiment of FIG. 1, are placed in series circuit with the transmission lines for antennas 26, 30 and 24 giving the antennas the directional radiation characteristic or lobe 31 indicated by the dash lines.

It is appreciated that the phase shifter of the invention accomplishes a phase adjustment without the use of inductors and is easily adjusted by changing the volummetric level of the dielectric, involving only simple mechanical actions of either pouring or dispensing that does not require any mechanical tools, such as a screwdriver or wrench, and does not require the transmitter to be turned off while making those adjustments.

The powders used should not be hygroscopic, but a mildly hygroscopic material should be acceptable in a high power system because the power in the line will keep the material dry. Furthermore, lines are normally kept dry with dry air under a small pressure. Powders should be chosen that do not settle or cake; however, if the powder tends to settle and cake for any reason, a small dielectric rod could be used for stoking through one of the ports.

It is believed that the foregoing description of the preferred embodiments of the invention is sufficient in detail to enable one skilled in the art to make and use the invention. However, it is expressly understood that the detail of the elements presented for the foregoing purposes is not intended to limit the scope of the invention, in as much as equivalents to those elements and other modifications thereof, all of which come within the scope of the invention, will become apparent to those skilled in the art upon reading this specification. Thus the invention is to be broadly construed within the full scope of the appended claims.

What is claimed is:

1. A high power adjustable RF phase shifter, comprising:

an elongate hollow cylinder having top and bottom ends and an electrically conductive inner cylindrical wall; an elongate center conductor centrally located in said cylinder and axially extending therein to define an annular chamber therebetween and an RF transmission path between said top and bottom ends; and a pair of rigid dielectric spacer means, one of said spacer means being located at a top end and the other spacer means being located at the bottom end of said cylinder for maintaining said center conductor in coaxial relationship with said cylindrical wall, said second spacer means also providing an annular bottom wall to said annular chamber;

first coupling means for coupling RF from an RF source to one end of said RF transmission path;

second coupling means for coupling RF energy from an opposed end of said RF transmission path to an RF load;

an outlet port located at a bottom end of said cylinder, said outlet port defining a small sized passage way with said passage way having an entrance opening into said annular chamber;

flowable dielectric material, said flowable dielectric material being housed within and at least partially filling said annular chamber and said outlet port;

said outlet port further defining a downwardly extending chute, whereby a portion of said dielectric material gravitates from said annular chamber into and down said chute;

a closure member located at an end of said outlet port for closing said outlet port to thereby prevent expression of said dielectric material from said chute, with said closure member being manually movable to open said outlet port, whereby dielectric material is dispensed from said annular chamber, reducing the quantity of dielectric material reposed in said annular chamber;

an inlet port at a top end of said cylinder, said inlet port being in communication with said chamber and defining a chute for said flowable dielectric material for conveying dielectric material, externally introduced into said inlet port, into said annular chamber under the influence of gravity;

said inlet and outlet ports being sized to prevent propagation of RF energy from said annular chamber therethrough to the exterior.

2. The invention as defined in claim 1, wherein said flowable dielectric material is of a dielectric constant $\epsilon$ and a magnetic permeability characteristic $\mu$ and in which the ratio of $\mu$ to $\epsilon$ is approximately unity.

3. The invention as defined in claim 1, wherein said flowable dielectric material comprises a mixture of a first material and a second material, said first material having a dielectric constant $\epsilon 1$ and a magnetic permeability characteristic $\mu 1$ and said second material having a dielectric constant $\epsilon 2$ and a magnetic permeability characteristic $\mu 2$ to define a collective dielectric constant $\epsilon$ and magnetic permeability characteristic $\mu$ for said dielectric material and in which the ratio of said $\mu$ to said $\epsilon$ is approximately unity.

4. The invention as defined in claim 1, wherein said dielectric material comprises a mixture of a plurality of substances each having associated dielectric and magnetic permeability characteristics and wherein the ratio of $\mu$ to $\epsilon$ is of said mixture is approximately unity.

5. The invention as defined in claim 1, wherein said flowable dielectric material further comprises a granular material.

6. The invention as defined in claim 4, wherein said flowable dielectric material further comprises a granular material.

7. The invention as defined in claim 1, wherein said flowable dielectric material further comprises a liquid material.

8. The invention as defined in claim 1, wherein said flowable dielectric material further comprises a slurry.

9. The invention as defined in claim 3, wherein said flowable dielectric material further comprises a granular material.

10. Electrical phase shifting apparatus, comprising:

a RF transmission line; said transmission line including an input end for inputting RF into said transmission line and an output end for expressing RF propagating through said transmission line, and having sides defining an internal cavity;

dielectric means located in said internal cavity in the path of propagation of said RF for increasing the electrical wavelength of said transmission line without increasing said physical length, said dielectric means comprising flowable dielectric material;

an inlet tube connected to said internal cavity, said inlet tube defining a gravity chute for said flowable dielectric material for dispensing, under the influence of gravity, dielectric material into said internal cavity; and an outlet tube connected to said internal cavity, said outlet tube defining a gravity chute for said flowable dielectric material for dispensing, under the influence of gravity, dielectric material from said internal cavity external of said RF transmission line.

11. The invention as defined in claim 10, wherein said flowable dielectric material further comprises a granular material.

12. The invention as defined in claim 10, wherein said flowable dielectric material further comprises a liquid material.

13. The invention as defined in claim 10, wherein said flowable dielectric material further comprises a slurry.

14. The invention as defined in claim 10, wherein said flowable dielectric material is of a dielectric constant $\epsilon$ and a magnetic permeability characteristic $\mu$ and in which the ratio of $\mu$ to $\epsilon$ is approximately unity.

15. The invention as defined in claim 11, wherein said flowable dielectric material is of a dielectric constant $\epsilon$ and a magnetic permeability characteristic $\mu$ and in which the ratio of $\mu$ to $\epsilon$ is approximately unity.

* * * * *